US009197017B2

(12) United States Patent
Wu

(10) Patent No.: US 9,197,017 B2
(45) Date of Patent: Nov. 24, 2015

(54) STRUCTURE OF A CONNECTION MEMBER WITH ENGAGING-DISENGAGING MEMBERS

(71) Applicant: DINKLE ENTERPRISE CO., LTD., New Taipei (TW)

(72) Inventor: Shang Tsai Wu, New Taipei (TW)

(73) Assignee: DINKLE ENTERPRISE CO., LTD., New Taipei (TW)

( * ) Notice: Subject to any disclaimer, the term of this patent is extended or adjusted under 35 U.S.C. 154(b) by 0 days.

(21) Appl. No.: 14/224,959

(22) Filed: Mar. 25, 2014

(65) Prior Publication Data

US 2014/0302703 A1 Oct. 9, 2014

(30) Foreign Application Priority Data

Apr. 8, 2013 (TW) ..... 102206320 U

(51) Int. Cl.
*H01R 13/62* (2006.01)
*H01R 13/629* (2006.01)
*H01R 13/633* (2006.01)

(52) U.S. Cl.
CPC ..... *H01R 13/62966* (2013.01); *H01R 13/6335* (2013.01); *Y10T 403/595* (2015.01)

(58) Field of Classification Search
CPC ..... H01R 13/62933; H01R 13/62938
USPC ..... 439/372, 157
See application file for complete search history.

(56) References Cited

U.S. PATENT DOCUMENTS

| | | | | | |
|---|---|---|---|---|---|
| 4,070,081 | A * | 1/1978 | Takahashi | ..... | 439/372 |
| 4,241,966 | A * | 12/1980 | Gomez | ..... | 439/157 |
| 5,322,448 | A * | 6/1994 | Hahn | ..... | 439/157 |
| 6,540,532 | B1 * | 4/2003 | Martin et al. | ..... | 439/157 |
| 6,638,085 | B1 * | 10/2003 | Martin | ..... | 439/157 |
| 7,029,298 | B2 * | 4/2006 | Jiang | ..... | 439/157 |
| 7,090,518 | B1 * | 8/2006 | Osada et al. | ..... | 439/157 |
| 7,645,150 | B1 * | 1/2010 | Chang | ..... | 439/157 |
| 7,938,658 | B1 * | 5/2011 | Zeng et al. | ..... | 439/160 |
| 7,955,098 | B1 * | 6/2011 | McKee et al. | ..... | 439/157 |
| 2012/0149223 | A1 * | 6/2012 | Feldman et al. | ..... | 439/157 |

* cited by examiner

*Primary Examiner* — Hae Moon Hyeon
(74) *Attorney, Agent, or Firm* — Birch, Stewart, Kolasch & Birch, LLP

(57) ABSTRACT

A fore connection member, comprising a fore connection member body and engaging-disengaging members. The engaging-disengaging members are pivoted to side surfaces of the fore connection member body respectively, and each comprise a recess, a grab, an operating end, an abutting end and a pivoting end. The engaging-disengaging members each have the pivoting end thereof pivoted to a corresponding one of the side surfaces and pivots about the fore connection member body. The operating end and the abutting end are disposed at two sides of the pivoting end respectively, the grab is provided with a hook portion facing the abutting end, and a circular arc abutting portion disposed at the abutting end comprises a circular arc abutting surface smoothly connected to the recess. A rear connection member for use with the fore connection member and a connection member comprising the fore connection member and the rear connection member are also provided.

6 Claims, 16 Drawing Sheets

STRUCTURE OF A CONNECTION MEMBER WITH ENGAGING-DISENGAGING MEMBERS

BACKGROUND OF THE INVENTION

1. Technical Field

The present invention relates to an improved structure of a connection member, and more particularly, to an improved structure of a connection member which is capable of increasing the convenience in engagement and disengagement, saving time and labor and improving the product quality.

2. Description of Related Art

A connection member (e.g., a terminal structure that is generally used for connecting signal lines in an electronic device) can be used to achieve the purpose of signal transmission. In other words, it is often needed to transmit a signal between different electronic parts in the electronic device; and in this case, the signal lines of the different electronic parts must be connected with each other so that the signal can be transmitted between the different electronic parts.

In order to connect the signal lines, the signal line of one of the electronic parts is integrated into a rear terminal structure (e.g., a male terminal structure), the signal line of another electronic part is integrated into a fore terminal structure (e.g., a female terminal structure corresponding to the male terminal structure), and then the rear terminal structure and the fore terminal structure are inserted into each other. In this way, signal transmission can be carried out between the different electronic parts.

As described above, the rear terminal structure and the fore terminal structure are inserted into each other, and the rear terminal structure and the fore terminal structure are disengaged from each other when being idle or maintained. However, whether having the rear terminal structure and the fore terminal structure inserted into or disengaged from each other, it is conventionally accomplished through manpower without design of a labor-saving or assistant construction. Consequently, the rear terminal structure and the fore terminal structure in the prior art are particularly inconvenient in use and are labor-intensive and time-consuming.

BRIEF SUMMARY OF THE INVENTION

A fore connection member of the present invention comprises a fore connection member body and two engaging-disengaging members.

The fore connection member body comprises two side surfaces. The two engaging-disengaging members are pivoted to the two side surfaces respectively and each comprise a recess, a grab, an operating end, an abutting end and a pivoting end. Each of the engaging-disengaging members has the pivoting end thereof pivoted to a corresponding one of the side surfaces of the fore connection member body and pivots about the fore connection member body. The operating end and the abutting end are disposed at two sides of the pivoting end respectively. The grab is provided with a hook portion facing the abutting end. The abutting end is provided with a circular arc abutting portion comprising a circular arc abutting surface, and the circular arc abutting surface is smoothly connected to the recess.

A distance from the operating end to the pivoting end is larger than a distance from the abutting end to the pivoting end.

The fore connection member is a fore terminal structure.

A rear connection member of the present invention is for use with the fore connection member as described above, and comprises a rear connection member body and two protrusions.

The rear connection member body comprises two side surfaces. The two protrusions are disposed on the two side surfaces respectively, and each comprise an abutting portion and a snap-fitting portion. Each of the protrusions has a recessed portion recessed longitudinally with respect to the abutting portion, and the recessed portion is smoothly connected to the abutting portion.

The rear connection member is a rear terminal structure.

A connection member of the present invention comprises the fore connection member and the rear connection member as described above. The rear connection member and the fore connection member are longitudinally inserted into each other. Each of the protrusions of the rear connection member is contained in the recess of each of the engaging-disengaging members of the fore connection member. The abutting end of each of the engaging-disengaging members of the fore connection member correspondingly extends into the recessed portion of each of the protrusions of the rear connection member, and the hook portion of each of the engaging-disengaging members of the fore connection member is correspondingly snap-fitted in the snap-fitting portion of each of the protrusions of the rear connection member.

The connection member is a terminal structure.

Accordingly, the purpose of increasing the convenience in engagement and disengagement, saving time and labor and improving the product quality can be achieved through the aforesaid structural design.

DETAILED DESCRIPTION OF THE INVENTION

Figure 1:
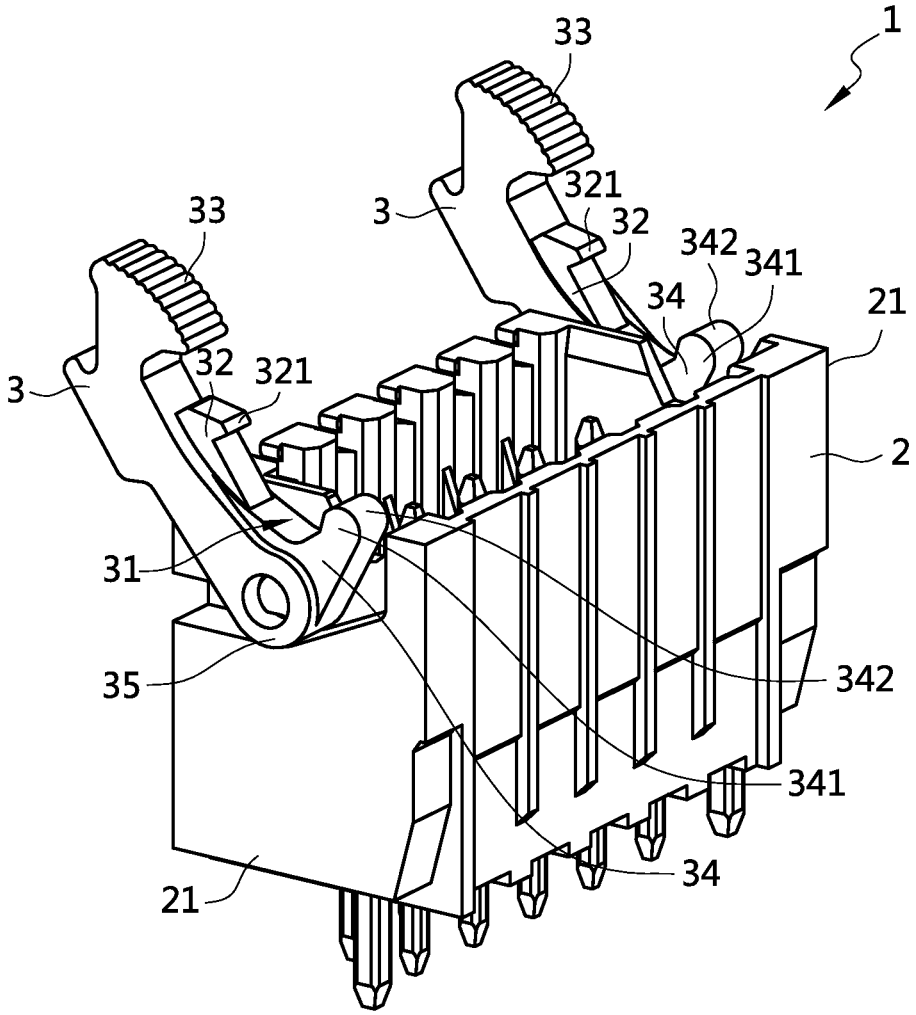
FIG. 1 is a perspective view of a fore connection member according to a first preferred embodiment of the present invention.

Referring to FIG. 1, there is shown a perspective view of a fore connection member according to a first preferred embodiment of the present invention.

FIG. 1 shows a fore connection member 1 (e.g., a fore terminal structure shown in FIG. 1), which comprises a fore connection member body 2 and two engaging-disengaging members 3. The fore connection member body 2 comprises two side surfaces 21. The two engaging-disengaging members 3 are pivoted to the two side surfaces 21 of the fore connection member body 2 respectively and each comprise a recess 31, a grab 32, an operating end 33, an abutting end 34 and a pivoting end 35. Each of the engaging-disengaging members 3 has the pivoting end 35 thereof pivoted to a corresponding one of the side surfaces 21 of the fore connection member body 2 and pivots about the fore connection member body 2. The operating end 33 and the abutting end 34 are disposed at two sides of the pivoting end 35 respectively. The grab 32 is provided with a hook portion 321 facing the abutting end 34. The abutting end 34 is provided with a circular arc abutting portion 341 comprising a circular arc abutting surface 342, and the circular arc abutting surface 342 is smoothly connected to the recess 31.

In the aforesaid structural design, the operating end 33, the pivoting end 35 and the abutting end 34 pivot according to the lever principle, and the detailed operations will be described hereinbelow.

Figure 2:
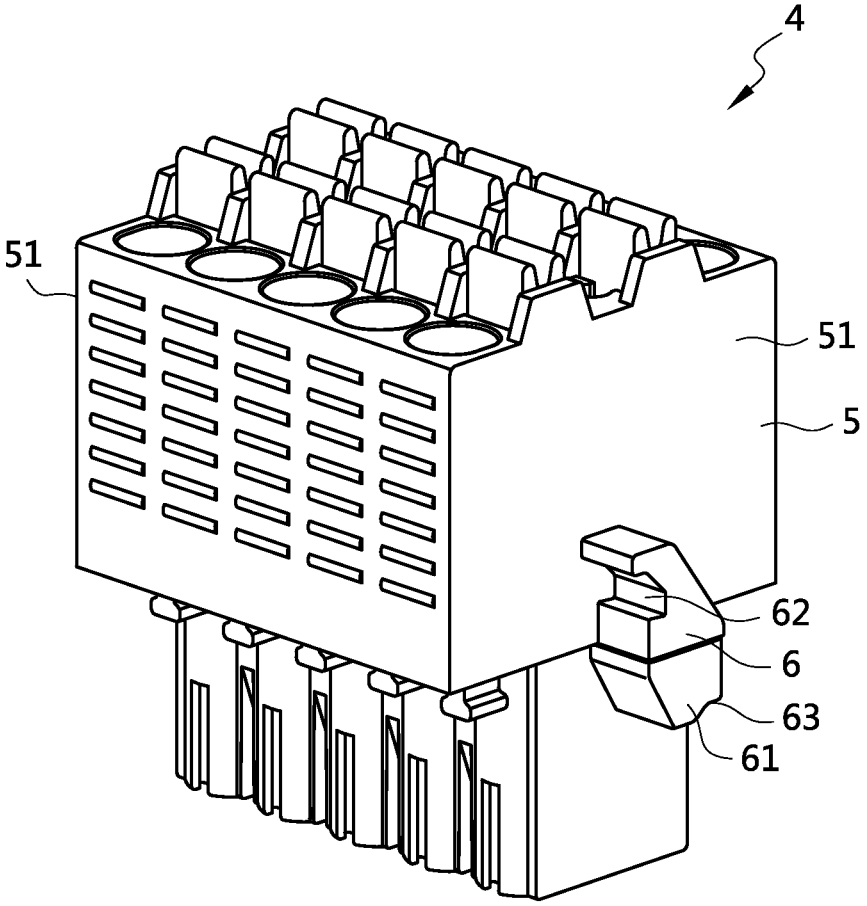
FIG. 2 is a perspective view of a rear connection member according to the first preferred embodiment of the present invention.

Referring to FIG. 2, there is shown a perspective view of a rear connection member according to the first preferred embodiment of the present invention.

FIG. 2 shows a rear connection member 4 (e.g., a rear terminal structure shown in FIG. 2) for use with the fore connection member 1 as described above, and the rear connection member 4 comprises a rear connection member body 5 and two protrusions 6. The rear connection member body 5 comprises two side surfaces 51. The two protrusions 6 are disposed on the two side surfaces 51 of the rear connection member body 5 respectively, and each comprise an abutting portion 61 and a snap-fitting portion 62. Each of the protrusions 6 has a recessed portion 63 recessed longitudinally with respect to the abutting portion 61, and the recessed portion 63 is smoothly connected to the abutting portion 61.

Figure 3:
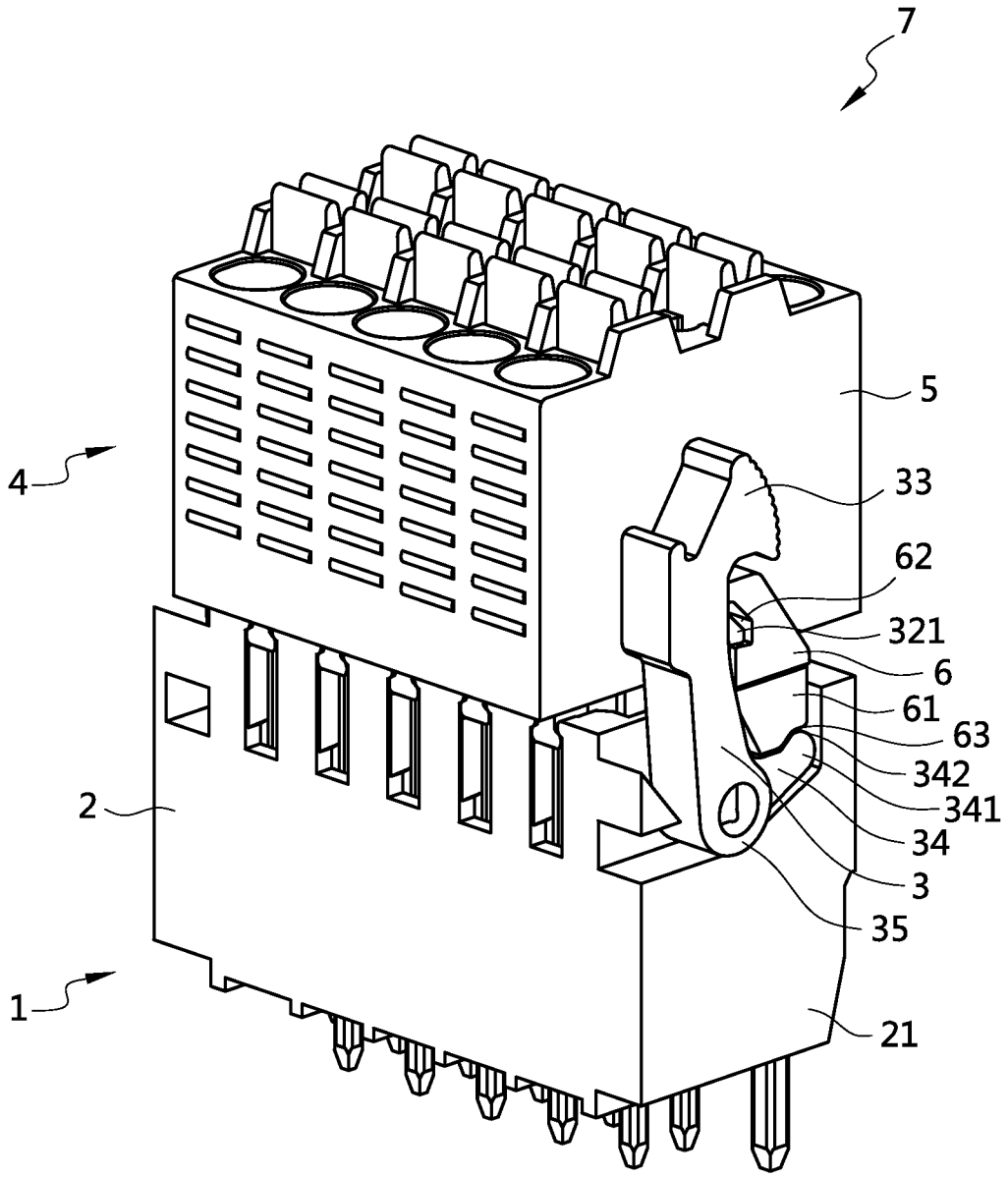
FIG. 3 is a perspective view of a connection member according to the first preferred embodiment of the present invention.

Referring to FIG. 3, there is shown a perspective view of a connection member according to the first preferred embodiment of the present invention.

FIG. 3 shows a connection member 7 (e.g., a terminal structure shown in FIG. 3), and the connection member 7 comprises the fore connection member 1 and the rear connection member 4 as described above. The rear connection member 4 and the fore connection member 1 are longitudinally inserted into each other. Each of the protrusions 6 of the rear connection member 4 is contained in the recess 31 of each of the engaging-disengaging members 3 of the fore connection member 1. The abutting end 34 of each of the engaging-disengaging members 3 of the fore connection member 1 correspondingly extends into the recessed portion 63 of each of the protrusions 6 of the rear connection member 4, and the hook portion 321 of each of the engaging-disengaging members 3 of the fore connection member 1 is correspondingly snap-fitted in the snap-fitting portion 62 of each of the protrusions 6 of the rear connection member 4.

Figure 4:
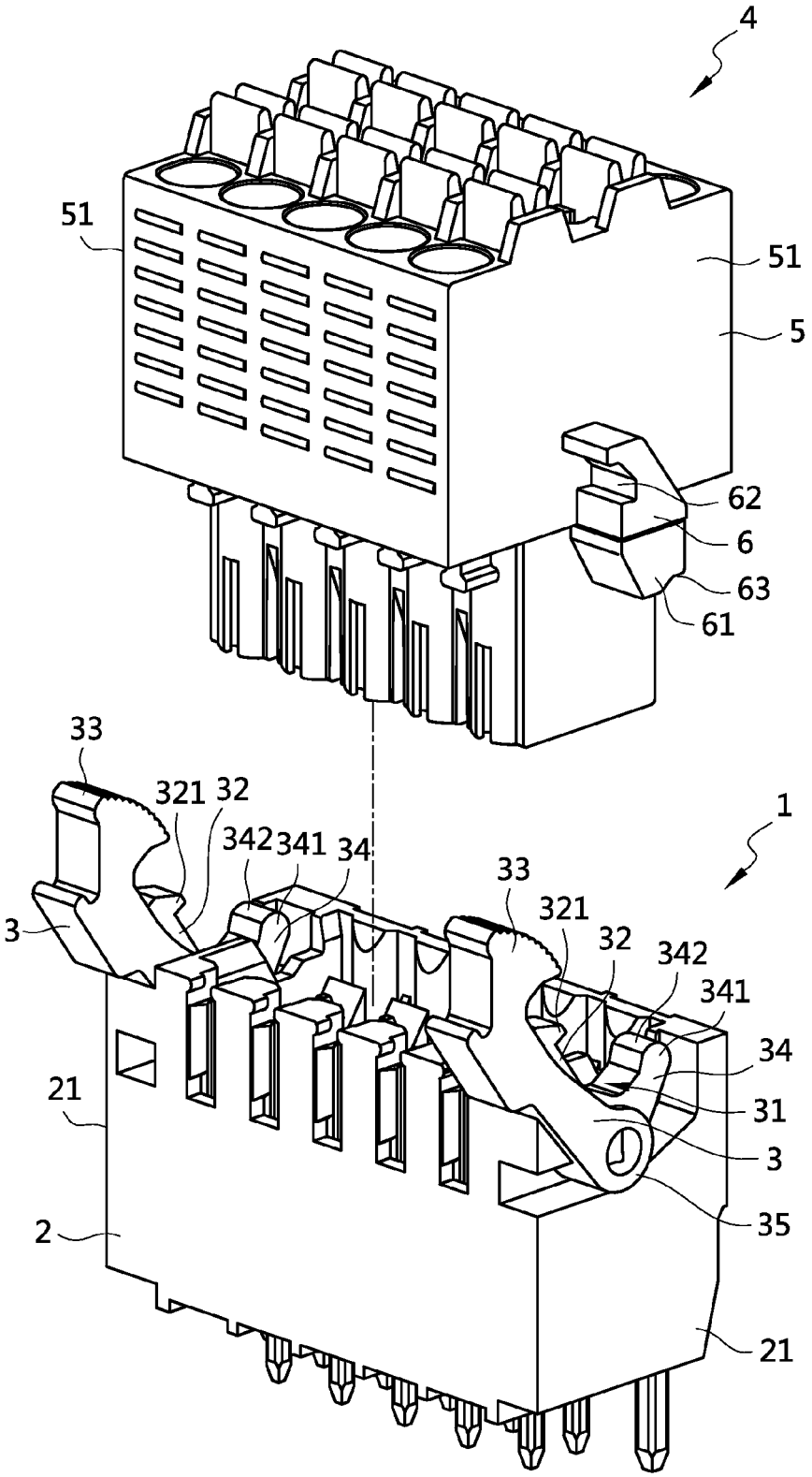
FIG. 4 is a schematic view I illustrating an action of snap-fitting the fore connection member and the rear connection member according to the first preferred embodiment of the present invention into each other.
Figure 5:
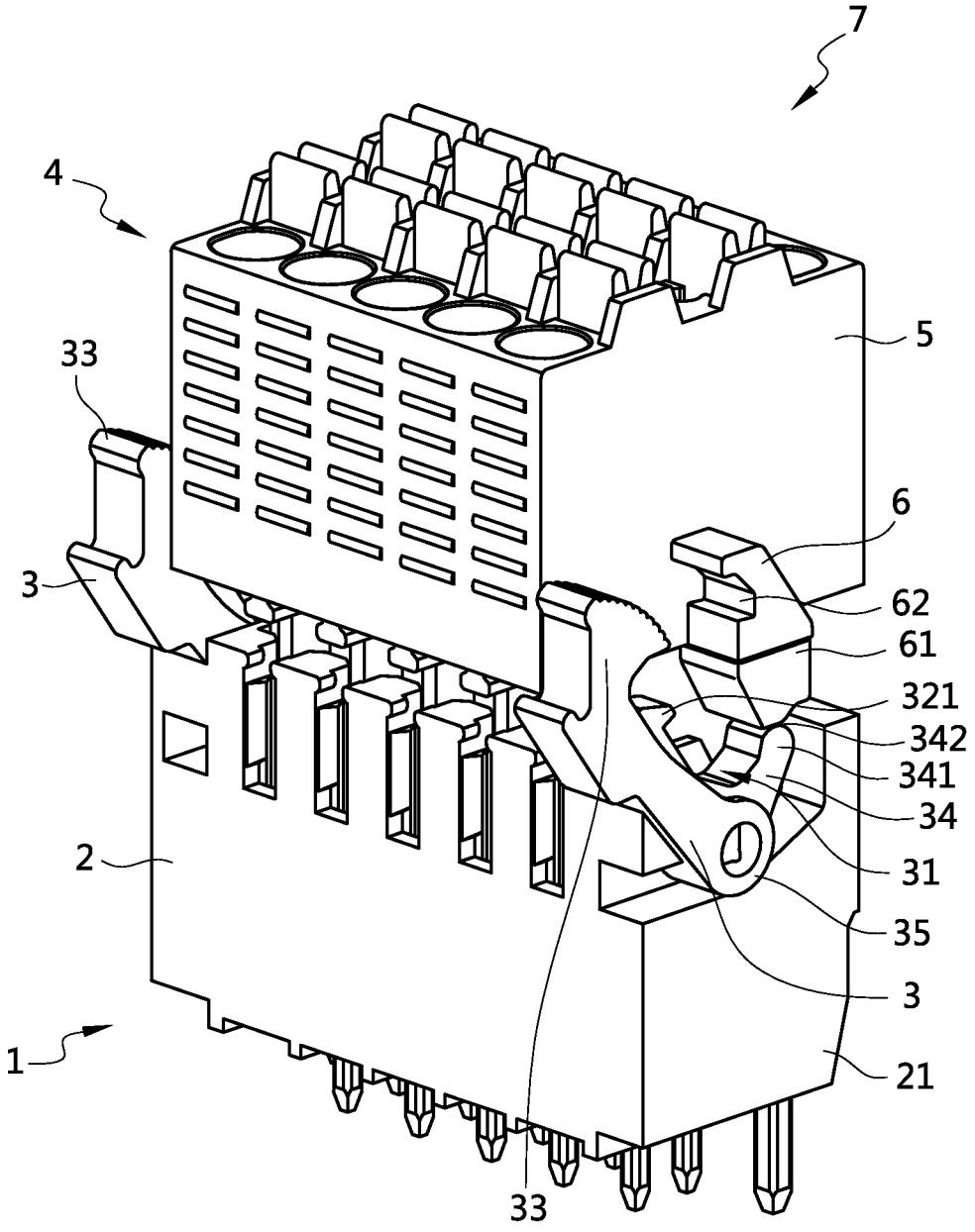
FIG. 5 is a schematic view II illustrating the action of snap-fitting the fore connection member and the rear connection member according to the first preferred embodiment of the present invention into each other.
Figure 6:
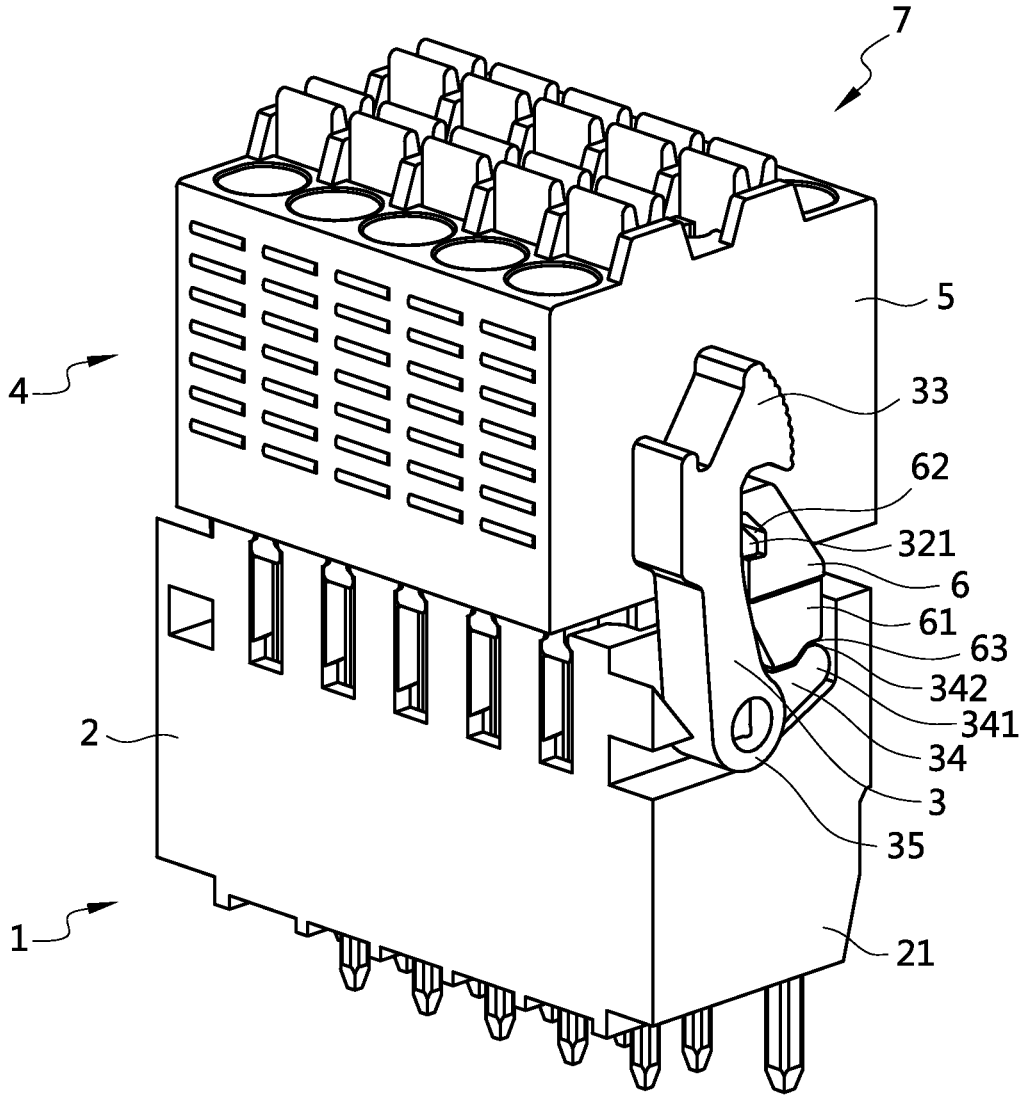
FIG. 6 is a schematic view III illustrating the action of snap-fitting the fore connection member and the rear connection member according to the first preferred embodiment of the present invention into each other.

Referring to FIG. 4 to FIG. 6 together, FIG. 4 is a schematic view I illustrating an action of snap-fitting the fore connection member and the rear connection member according to the first preferred embodiment of the present invention into each other; FIG. 5 is a schematic view II illustrating the action of snap-fitting the fore connection member and the rear connection member according to the first preferred embodiment of the present invention into each other; and FIG. 6 is a schematic view III illustrating the action of snap-fitting the fore connection member and the rear connection member according to the first preferred embodiment of the present invention into each other. Also, refer to FIG. 1 and FIG. 2 together.

The fore connection member 1 and the rear connection member 4 are longitudinally inserted and snap-fitted into each other, as shown in FIG. 4. Thereafter, the abutting portion 61 of each of the protrusions 6 of the rear connection member 4 firstly makes contact with and abuts against the circular arc abutting portion 341 of the abutting end 34 of each of the engaging-disengaging members 3 of the fore connection member 1, as shown in FIG. 5. Because the circular arc abutting portion 341 comprises the circular arc abutting surface 342 which is smoothly connected to the recess 31, each of the protrusions 6 of the rear connection member 4 can smoothly slide into the recess 31 of each of the engaging-disengaging members 3 of the fore connection member 1, as shown in FIG. 6. Meanwhile, because the operating end 33, the pivoting end 35 and the abutting end 34 of each of the engaging-disengaging members 3 of the fore connection member 1 pivot according to the lever principle, each of the engaging-disengaging members 3 of the fore connection member 1 pivots about the fore connection member body 2 when the abutting portion 61 of each of the protrusions 6 of the rear connection member 4 abuts against the circular arc abutting portion 341 of the abutting end 34 of each of the engaging-disengaging members 3 of the fore connection member 1. Moreover, the grab 32 of each of the engaging-disengaging members 3 pivots towards each of the protrusions 6 of the rear connection member 4, and the hook portion 321 is correspondingly snap-fitted in the snap-fitting portion 62. Meanwhile, the abutting end 34 of each of the engaging-disengaging members 3 of the fore connection member 1 correspondingly extends into the recessed portion 63 of each of the protrusions 6 of the rear connection member 4. Thus, the fore connection member 1 and the rear connection member 4 are longitudinally inserted and snap-fitted into each other to form the connection member 7. In other words, when it is desired to longitudinally insert and snap-fit the fore connection member 1 and the rear connection member 4 into each other, the fore connection member 1 and the rear connection member 4 can be automatically snap-fitted into each other in a time-saving and labor-saving way so long as they are close to and press each other.

Figure 7:
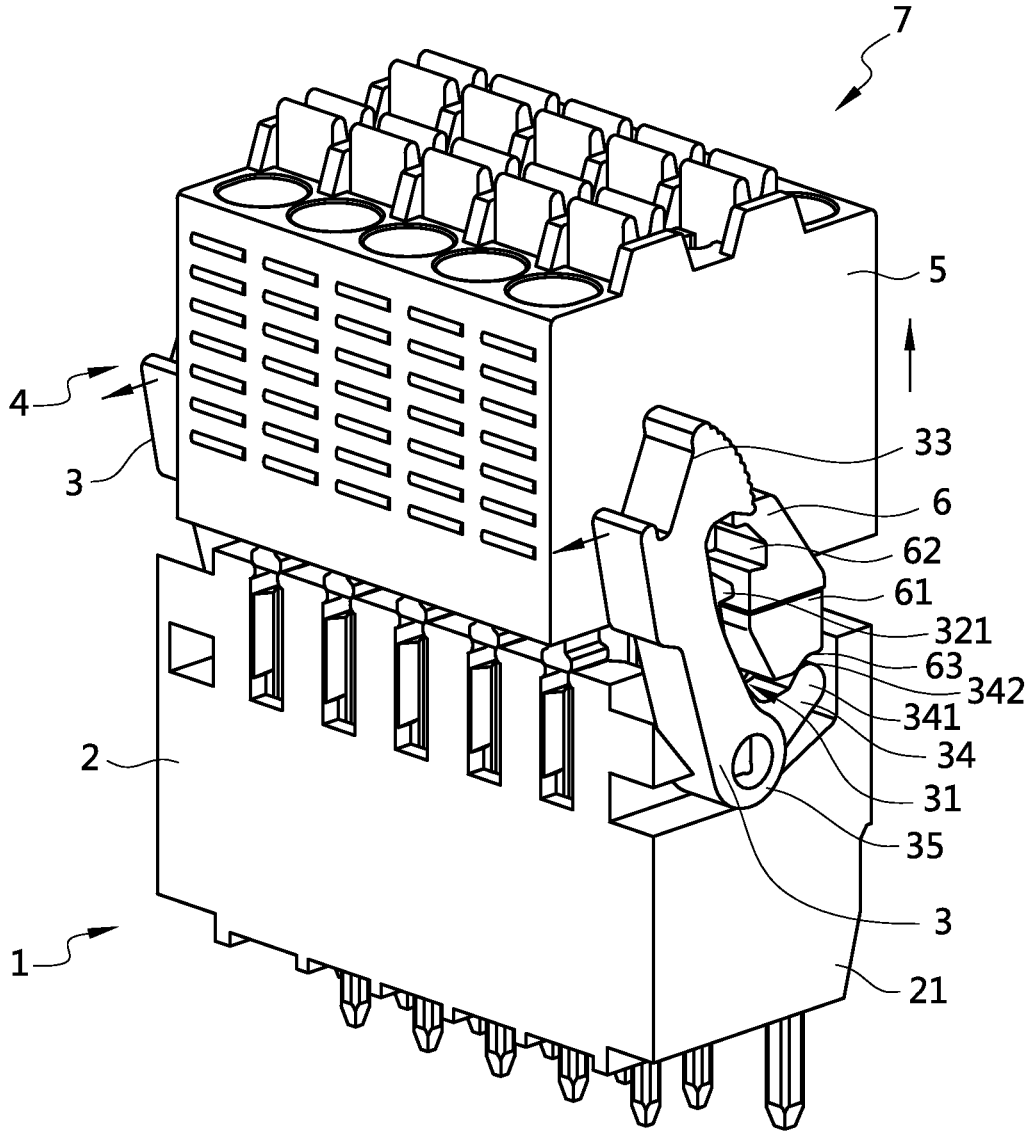
FIG. 7 is a schematic view I illustrating an action of disengaging the fore connection member and the rear connection member according to the first preferred embodiment of the present invention from each other.
Figure 8:
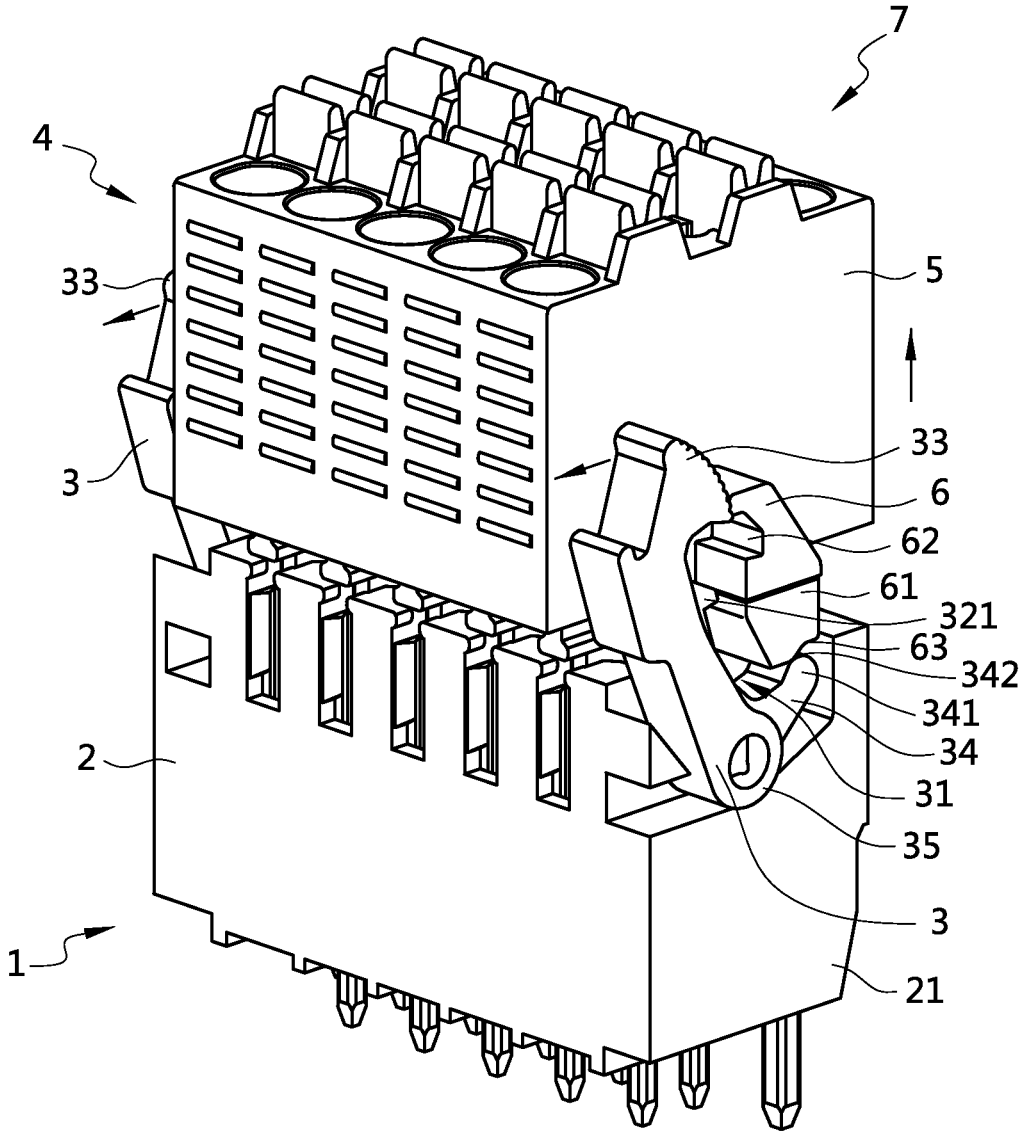
FIG. 8 is a schematic view II illustrating the action of disengaging the fore connection member and the rear connection member according to the first preferred embodiment of the present invention from each other.
Figure 9:
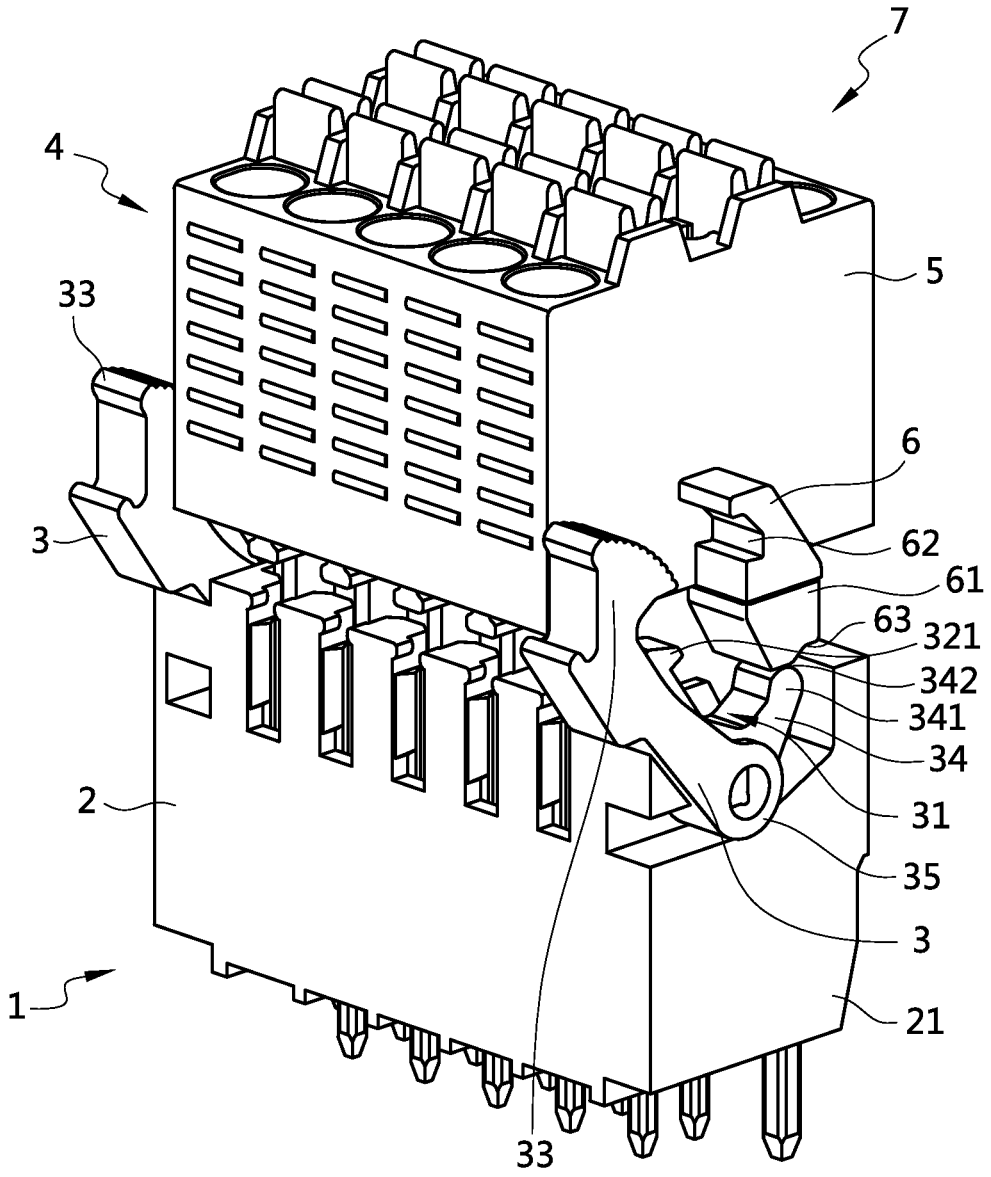
FIG. 9 is a schematic view III illustrating the action of disengaging the fore connection member and the rear connection member according to the first preferred embodiment of the present invention from each other.

Referring to FIG. 7 to FIG. 9 together, FIG. 7 is a schematic view I illustrating an action of disengaging the fore connection member and the rear connection member according to the first preferred embodiment of the present invention from each other; FIG. 8 is a schematic view II illustrating the action of disengaging the fore connection member and the rear connection member according to the first preferred embodiment of the present invention from each other; and FIG. 9 is a schematic view III illustrating the action of disengaging the fore connection member and the rear connection member according to the first preferred embodiment of the present invention from each other. Also, refer to FIG. 1 and FIG. 2 together.

On the contrary, when it is desired to disengage the fore connection member 1 and the rear connection member 4 from each other, the operating end 33 of each of the engaging-disengaging members 3 of the fore connection member 1 can be pulled by a force, as shown by an arrow of FIG. 7. Thereafter, as shown in FIG. 8, each of the engaging-disengaging members 3 of the fore connection member 1 also pivots about the fore connection member body 2 with the pivoting end 35 pivoted to the fore connection member body 2 being used as a rotation shaft, and drives the abutting end 34 to pivot. Thereby, the abutting end 34 of each of the engaging-disengaging members 3 of the fore connection member 1 firstly abuts against the recessed portion 63 of each of the protrusions 6 of the rear connection member 4 to disengage the fore connection member 1 and the rear connection member 4 from each other by a distance (as shown in FIG. 8, the fore connection member 1 and the rear connection member 4 are disengaged from each other by a distance). Likewise, because the circular arc abutting portion 341 of the abutting end 34 of each of the engaging-disengaging members 3 of the fore connection member 1 comprises the circular arc abutting surface 342 which is smoothly connected to the recess 31, each of the protrusions 6 of the rear connection member 4 can smoothly slide out of the recess 31. Then, each of the engaging-disengaging members 3 also further pivots about the fore connection member body 2 with the pivoting end 35 pivoted to the fore connection member body 2 being used as a rotation shaft, and also drives the abutting end 34 to further pivot. Because the recessed portion 63 of each of the protrusions 6 is smoothly connected to the abutting portion 61, the circular arc abutting portion 341 of the abutting end 34 of each of the engaging-disengaging members 3 of the fore connection member 1 slides from the recessed portion 63 of each of the protrusions 6 of the rear connection member 4 to the abutting portion 61 smoothly and abuts against the abutting portion 61 so that the abutting portion 61 is moved away from the circular arc abutting portion 341 (i.e., the fore connection member 1 and the rear connection member 4 are further disengaged from each other by a larger distance). Meanwhile, the grab 32 of each of the engaging-disengaging members 3 of the fore connection member 1 is disengaged from the snap-fitting portion 62 of each of the protrusions 6 of the rear connection member 4 (i.e., the fore connection member 1 and the rear connection member 4 are completely disengaged from each other), as shown in FIG. 9.

As described above, when it is desired to disengage the fore connection member 1 and the rear connection member 4 from each other, it is only needed to apply a force to the operating end 33 of each of the engaging-disengaging members 3 and enable the circular arc abutting portion 341 of the abutting end 34 of each of the engaging-disengaging members 3 to abut against the recessed portion 63 of each of the protrusions 6 according to the lever principle so that the fore connection member 1 and the rear connection member 4 abut against each other to be disengaged by a distance firstly. Thereafter, the circular arc abutting portion 341 of the abutting end 34 of each of the engaging-disengaging members 3 smoothly slides to and abuts against the abutting portion 61 so that the fore connection member 1 and the rear connection member 4 abut against each other to be disengaged by a larger distance. In this way, the fore connection member 1 and the rear connection member 4 can be disengaged from each other in a time-saving and labor-saving way. Through the structural design of two-stage disengagement, the fore connection member 1 and the rear connection member 4 can be completely loosened during disengagement so as to be completely disengaged from each other; that is, when a force is applied to the operating end 33 of each of the engaging-disengaging members 3 to disengage the fore connection member 1 and the rear connection member 4 from each other, a maximum displacement can be achieved at a minimum operating angle (pivoting the engaging-disengaging member 3) (the circular arc abutting portion 341 of the abutting end 34 of the engaging-disengaging member 3 firstly abuts against the recessed portion 63 of each of the protrusions 6 and then abuts against the abutting portion 61).

As described above, no matter when the fore connection member 1 and the rear connection member 4 are snap-fitted into or disengaged from each other, the aforesaid purpose can be achieved simply and successfully through the aforesaid structural design (i.e., the purpose of increasing the convenience in engagement and disengagement, saving time and labor and improving the product quality can be achieved through the aforesaid structural design).

Referring to FIG. 1 again, in this embodiment, a distance from the operating end 33 of each of the engaging-disengaging members 3 to the pivoting end 35 is larger than a distance from the abutting end 34 to the pivoting end 35. This distance (length) design may be changed depending on actual needs; that is, the aforesaid distance (length) design may be changed depending on actual needs under the consideration of the lever principle (the moment).

The fore connection member, the rear connection member and the connection member formed by them may be such structures as terminal blocks, connectors and tracks. For example, the fore connection member is a female terminal structure, the rear connection member is a male terminal structure, and the connection member is a terminal structure.

Figure 10:
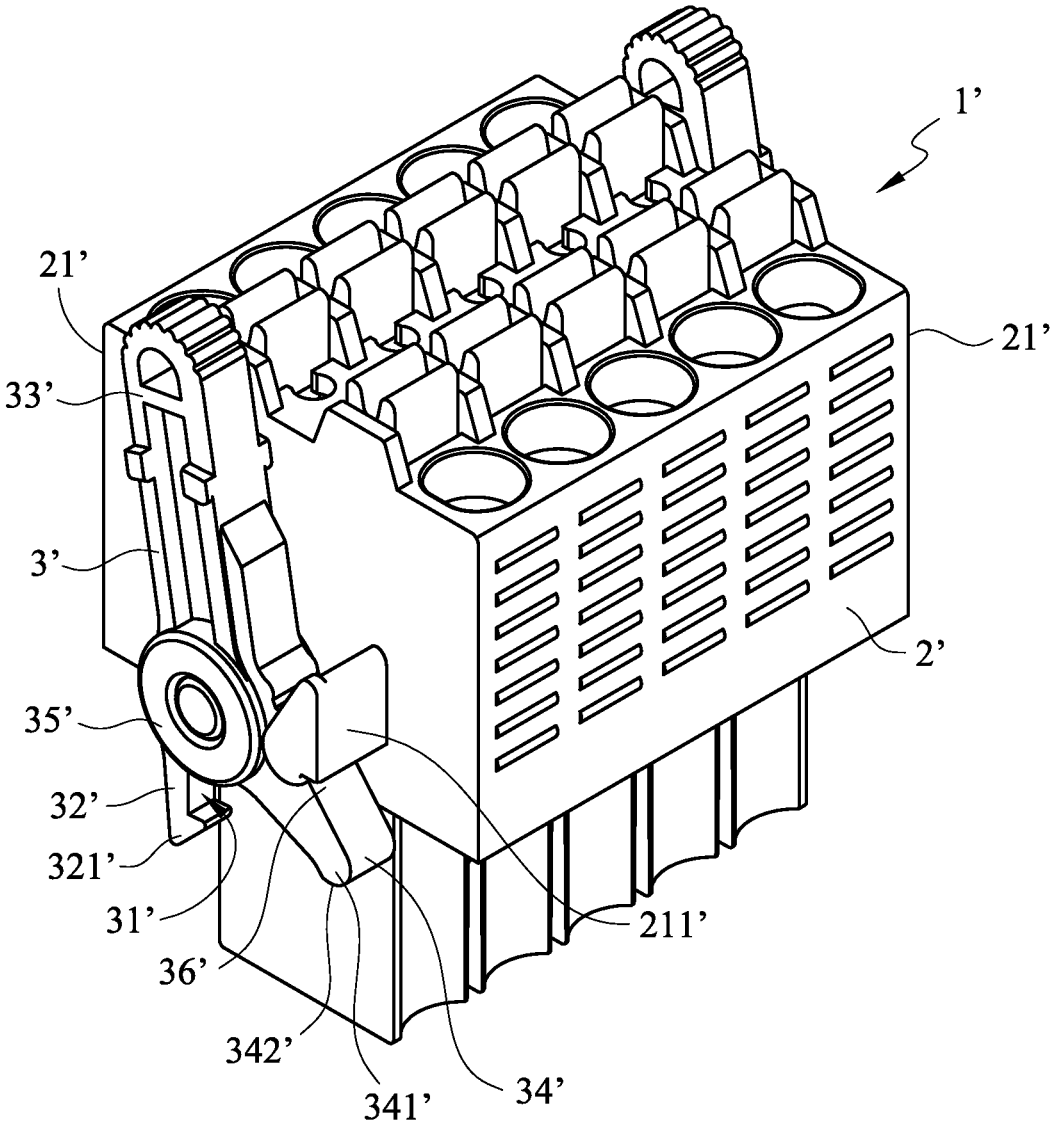
FIG. 10 is a perspective view of a fore connection member according to a second preferred embodiment of the present invention.

Referring to FIG. 10, there is shown a perspective view of a fore connection member according to a second preferred embodiment of the present invention.

FIG. 10 shows a fore connection member 1' (e.g., a fore terminal structure shown in FIG. 10), which comprises a fore connection member body 2' and two engaging-disengaging members 3'. The fore connection member body 2' comprises two side surfaces 21'. The two engaging-disengaging members 3' are pivoted to the two side surfaces 21' of the fore connection member body 2' respectively and each comprise a recess 31', a grab 32', an operating end 33', an abutting end 34' and a pivoting end 35'. Each of the engaging-disengaging members 3' has the pivoting end 35' thereof pivoted to a corresponding one of the side surfaces 21' of the fore connection member body 2' and pivots about the fore connection member body 2'. The operating end 33' and the abutting end 34' are disposed at two sides of the pivoting end 35' respectively. The grab 32' is provided with a hook portion 321' facing the abutting end 34'. The abutting end 34' is provided with a circular arc abutting portion 341' comprising a circular arc abutting surface 342', and the circular arc abutting surface 342' is smoothly connected to the recess 31'.

In the aforesaid structural design, like the first preferred embodiment, the operating end 33', the pivoting end 35' and the abutting end 34' pivot according to the lever principle, and the detailed operations will be described hereinbelow.

Figure 11:
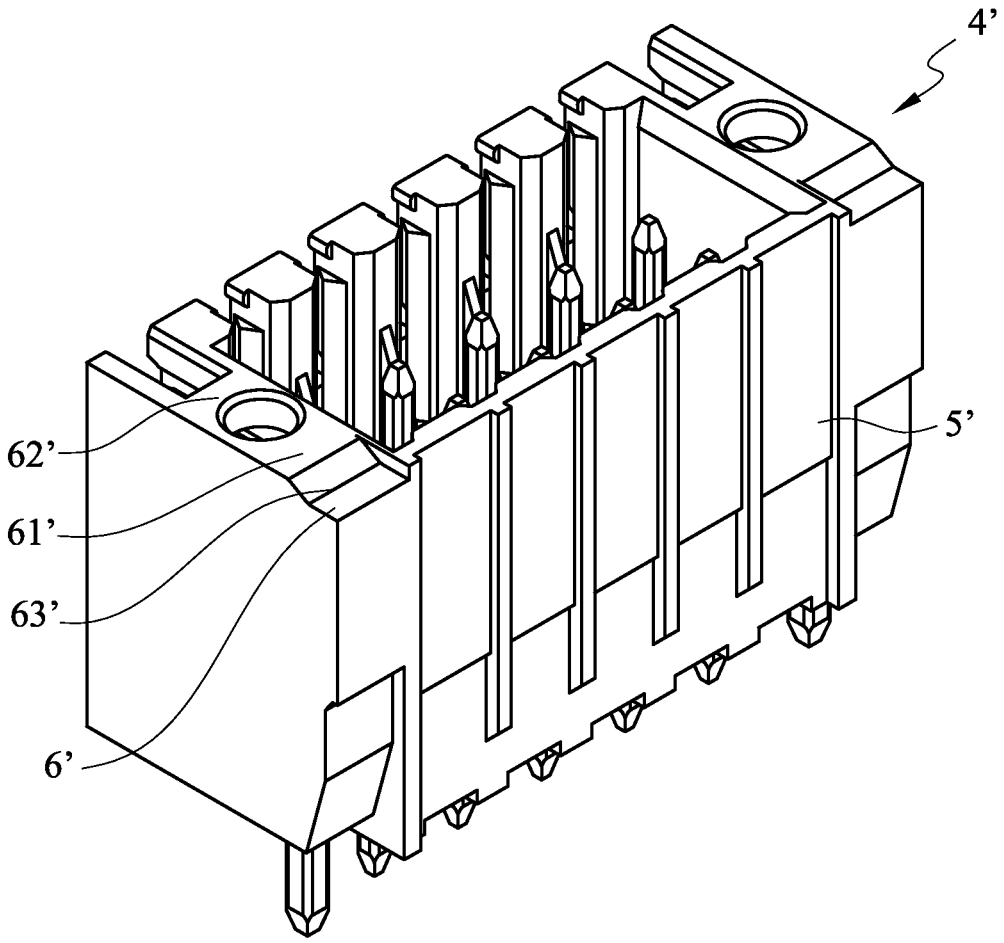
FIG. 11 is a perspective view of a rear connection member according to the second preferred embodiment of the present invention.

Referring to FIG. 11, there is shown a perspective view of a rear connection member according to the second preferred embodiment of the present invention. Also, referring to FIG. 13 together, there is shown a schematic view I illustrating an action of snap-fitting the fore connection member and the rear connection member according to the second preferred embodiment of the present invention into each other.

FIG. 11 shows a rear connection member 4' (e.g., a rear terminal structure shown in FIG. 11) for use with the fore connection member 1' as described above, and the rear connection member 4' comprises a rear connection member body 5' and two protrusions 6'. The rear connection member body 5' comprises two side surfaces 51' (referring to FIG. 13). The two protrusions 6' are disposed on the two side surfaces 51' of the rear connection member body 5' respectively, and each comprise an abutting portion 61' (referring to FIG. 13) and a snap-fitting portion 62' (referring to FIG. 13). Each of the protrusions 6' has a recessed portion 63' (referring to FIG. 13) recessed longitudinally with respect to the abutting portion 61', and the recessed portion 63' is smoothly connected to the abutting portion 61'.

Figure 12:
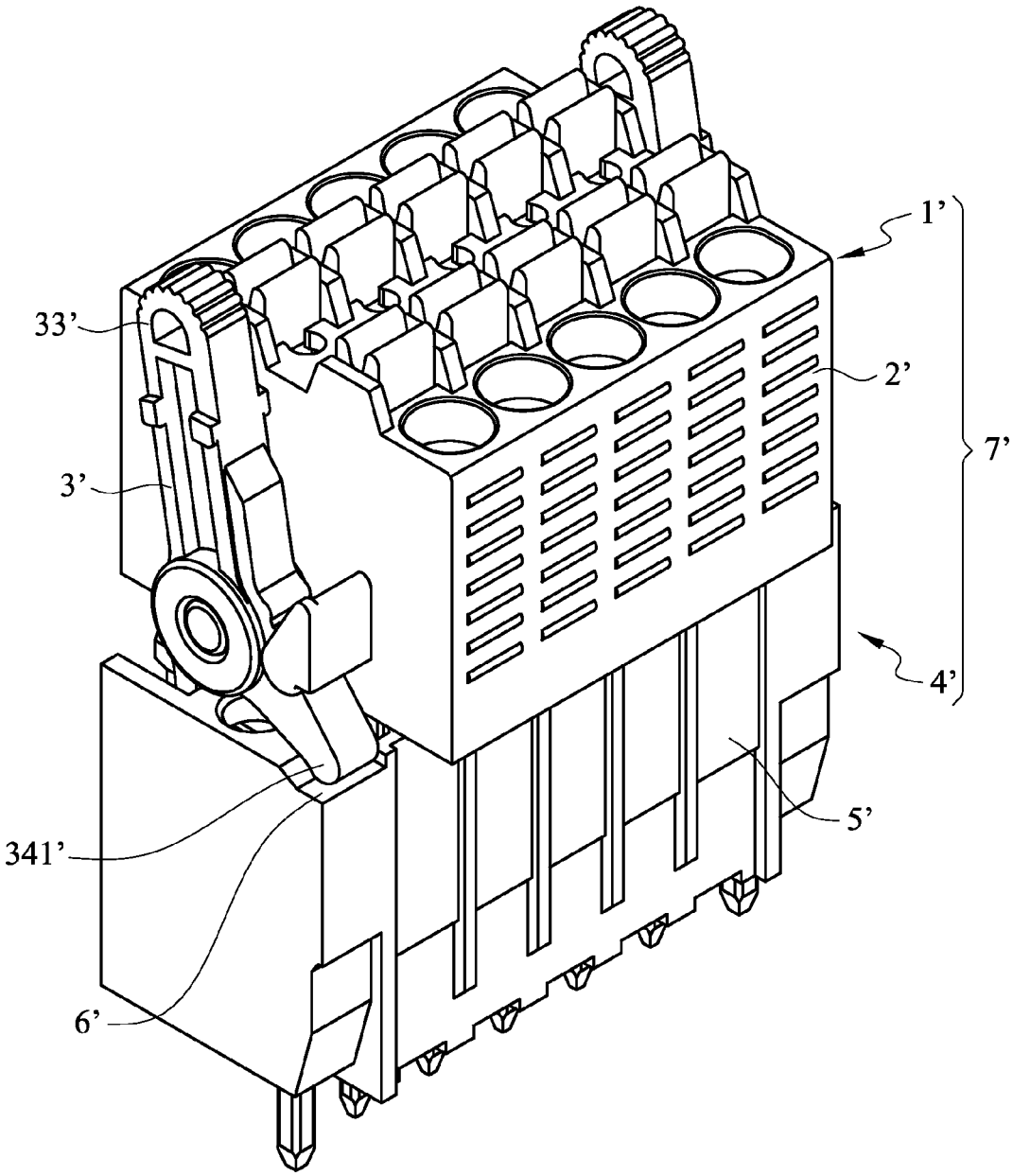
FIG. 12 is a perspective view of a connection member according to the second preferred embodiment of the present invention.

Referring to FIG. 12, there is shown a perspective view of a connection member according to the second preferred embodiment of the present invention. Also. referring to FIG. 16 together, there is shown a schematic view IV illustrating the action of snap-fitting the fore connection member and the rear connection member according to the second preferred embodiment of the present invention into each other.

FIG. 12 shows a connection member 7' (e.g., a terminal structure shown in FIG. 12), and the connection member 7' comprises the fore connection member 1' and the rear connection member 4' as described above. As can be known from FIG. 12 and FIG. 16, the rear connection member 4' and the fore connection member 1' are longitudinally inserted into each other. Each of the protrusions 6' of the rear connection member 4' is contained in the recess 31' of each of the engaging-disengaging members 3' of the fore connection member P. The abutting end 34' of each of the engaging-disengaging members 3' of the fore connection member 1' correspondingly extends into the recessed portion 63' of each of the protrusions 6' of the rear connection member 4', and the hook portion 321' of each of the engaging-disengaging members 3' of the fore connection member 1' is correspondingly snap-fitted in the snap-fitting portion 62' of each of the protrusions 6' of the rear connection member 4'.

Figure 13:
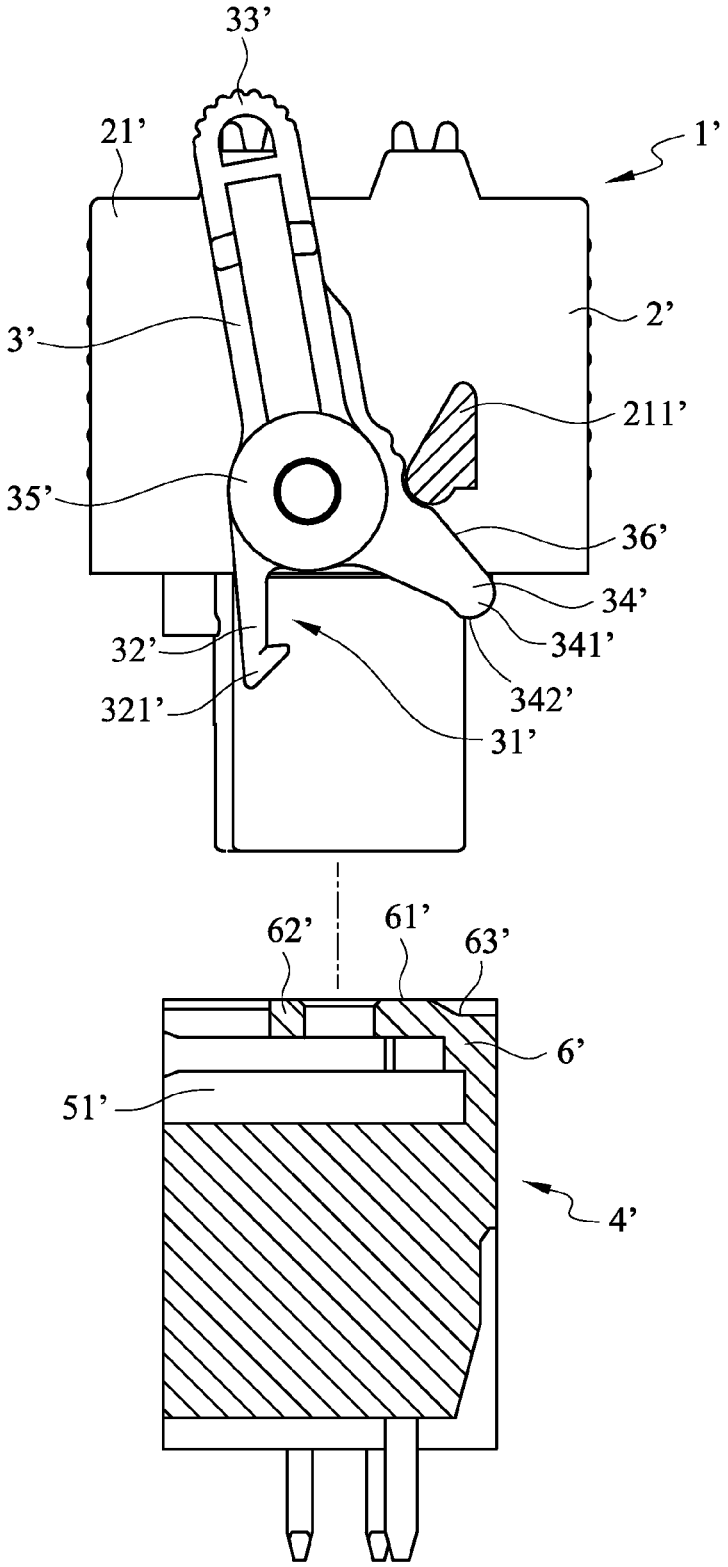
FIG. 13 is a schematic view I illustrating an action of snap-fitting the fore connection member and the rear connection member according to the second preferred embodiment of the present invention into each other.
Figure 14:
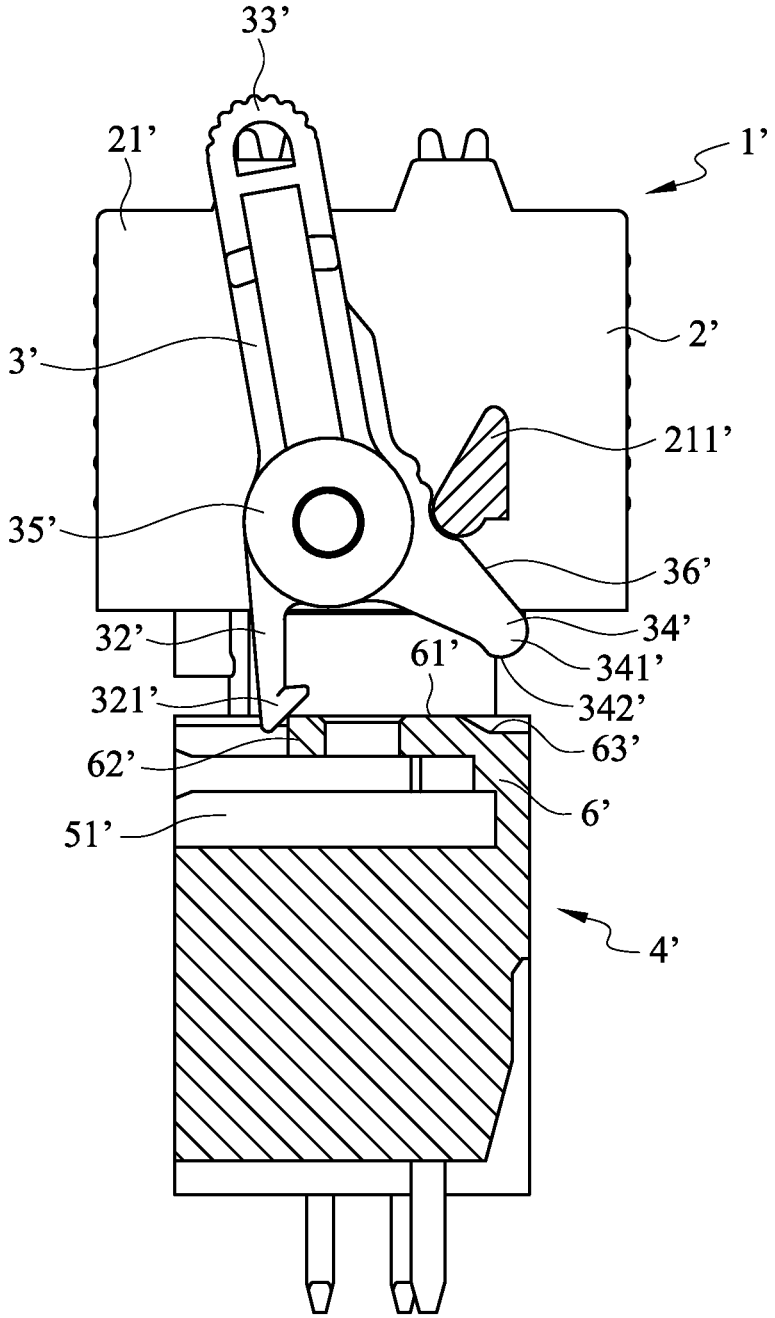
FIG. 14 is a schematic view II illustrating the action of snap-fitting the fore connection member and the rear connection member according to the second preferred embodiment of the present invention into each other.
Figure 15:
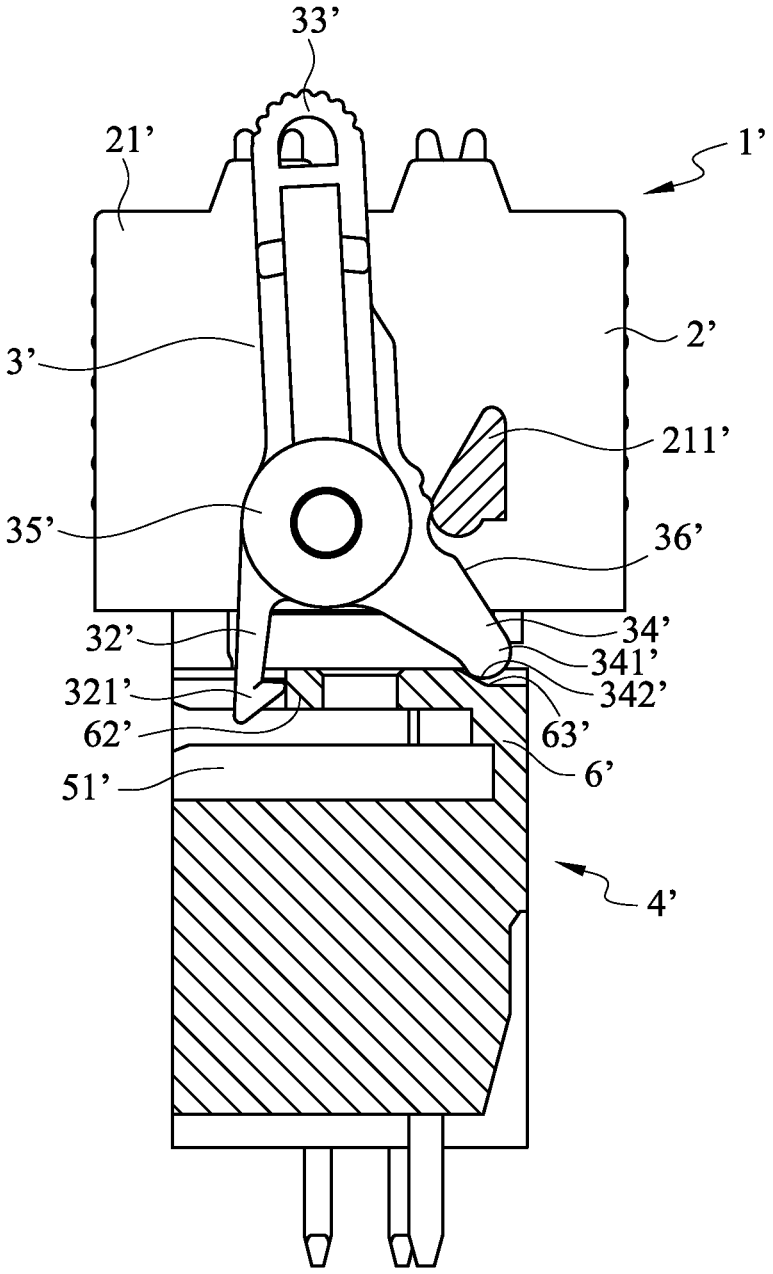
FIG. 15 is a schematic view III illustrating the action of snap-fitting the fore connection member and the rear connection member according to the second preferred embodiment of the present invention into each other.
Figure 16:
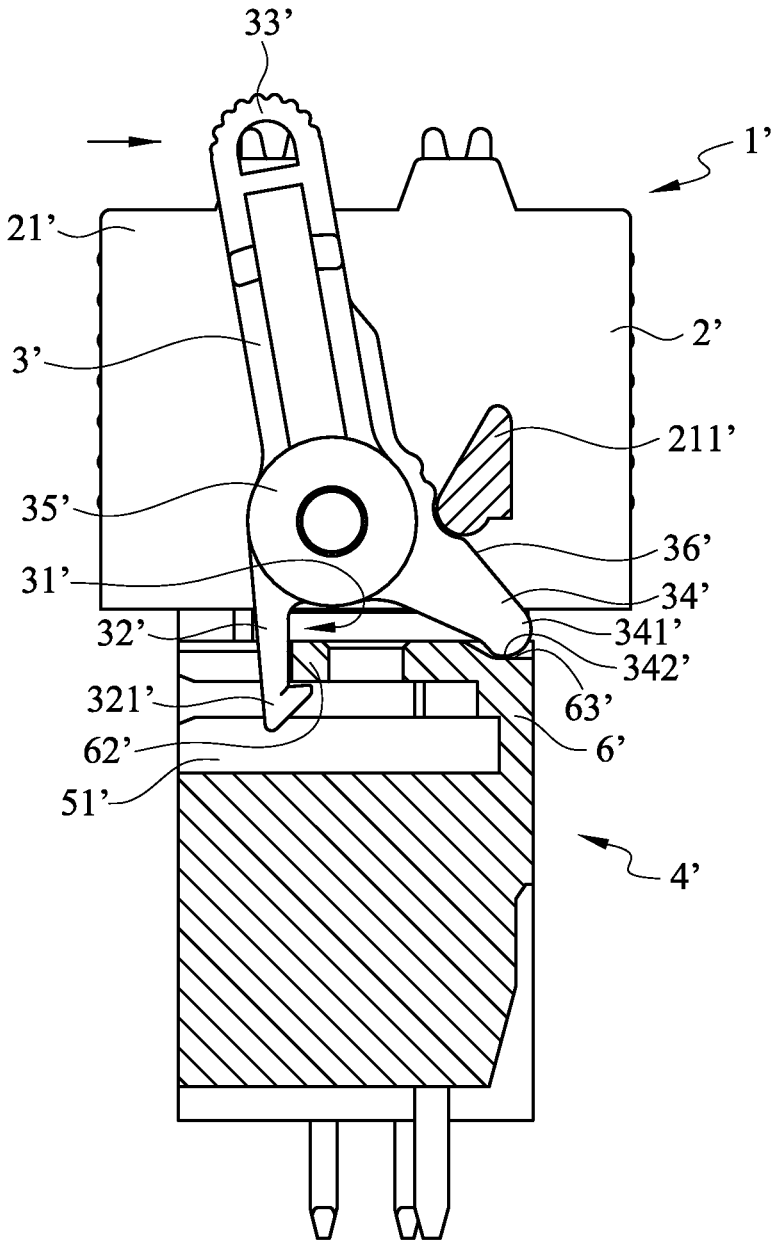
FIG. 16 is a schematic view IV illustrating the action of snap-fitting the fore connection member and the rear connection member according to the second preferred embodiment of the present invention into each other.

Referring to FIG. 13 to FIG. 16 together, FIG. 13 is a schematic view I illustrating an action of snap-fitting the fore connection member and the rear connection member according to the second preferred embodiment of the present invention into each other as described above; FIG. 14 is a schematic view II illustrating the action of snap-fitting the fore connection member and the rear connection member according to the second preferred embodiment of the present invention into each other; FIG. 15 is a schematic view III illustrating the action of snap-fitting the fore connection member and the rear connection member according to the second preferred embodiment of the present invention into each other; and FIG. 16 is a schematic view IV illustrating the action of snap-fitting the fore connection member and the rear connection member according to the second preferred embodiment of the present invention into each other as described above. Also, refer to FIG. 10 and FIG. 11 together.

The fore connection member 1' and the rear connection member 4' are longitudinally inserted and snap-fitted into each other, as shown in FIG. 13. Then, the abutting portion 61' of each of the protrusions 6' of the rear connection member 4' firstly makes contact with and abuts against the circular arc abutting portion 341' of the abutting end 34' of each of the engaging-disengaging members 3' of the fore connection member 1', as shown in FIG. 14. Because the circular arc abutting portion 341' comprises the circular arc abutting surface 342' which is smoothly connected to the recess 31', each of the protrusions 6' of the rear connection member 4' can smoothly slide into the recess 31' of each of the engaging-disengaging members 3' of the fore connection member 1', as shown in FIG. 15. Meanwhile, because the operating end 33', the pivoting end 35' and the abutting end 34' of each of the engaging-disengaging members 3' of the fore connection member 1' pivot according to the lever principle, each of the engaging-disengaging members 3' of the fore connection member 1' pivots about the fore connection member body 2' when the abutting portion 61' of each of the protrusions 6' of the rear connection member 4' abuts against the circular arc abutting portion 341' of the abutting end 34' of each of the engaging-disengaging members 3' of the fore connection member P. Moreover, the grab 32' of each of the engaging-disengaging members 3' pivots towards each of the protrusions 6' of the rear connection member 4', and the hook portion 321' is correspondingly snap-fitted in the snap-fitting portion 62'. Meanwhile, the abutting end 34' of each of the engaging-disengaging members 3' of the fore connection member 1' correspondingly extends into the recessed portion 63' of each of the protrusions 6' of the rear connection member 4'. Thus, the fore connection member 1' and the rear connection member 4' are longitudinally inserted and snap-fitted into each other to form the connection member 7', as shown in FIG. 16. In other words, when it is desired to longitudinally insert and snap-fit the fore connection member 1' and the rear connection member 4' into each other, the fore connection member 1' and the rear connection member 4' can be automatically snap-fitted into each other in a time-saving and labor-saving way so long as they are close to and press each other.

Refer again to FIG. 13, FIG. 15 and FIG. 16 together, and also refer to FIG. 10 and FIG. 11 together.

On the contrary, when it is desired to disengage the fore connection member 1' and the rear connection member 4' from each other, it is only needed to execute the operations in the order opposite to that shown in FIG. 13, FIG. 15 and FIG. 16, and the operations are all as described in the first preferred embodiment. In other words, the operating end 33' of each of the engaging-disengaging members 3' of the fore connection member 1' can be pulled by a force, as shown by an arrow of FIG. 16. Likewise, because the circular arc abutting portion 341' of the abutting end 34' of each of the engaging-disengaging members 3' of the fore connection member 1' comprises the circular arc abutting surface 342' which is smoothly connected to the recess 31', each of the protrusions 6' of the rear connection member 4' can smoothly slide out of the recess 31', as shown in FIG. 15. Meanwhile, each of the engaging-disengaging members 3' also pivots about the fore connection member body 2' with the pivoting end 35' pivoted to the fore connection member body 2' being used as a rotation shaft, and drives the abutting end 34' to pivot. Therefore, the circular arc abutting portion 341' of the abutting end 34' of each of the engaging-disengaging members 3' of the fore connection member 1' abuts against the abutting portion 61' of each of the protrusions 6' of the rear connection member 4' so that the abutting portion 61' is moved away from the circular arc abutting portion 341', and the grab 32' of each of the engaging-disengaging members 3' of the fore connection member 1' is disengaged from the snap-fitting portion 62' of each of the protrusions 6' of the rear connection member 4' (i.e., the fore connection member 1' and the rear connection member 4' are disengaged from each other), as shown in FIG. 13. In other words, when it is desired to disengage the fore connection member 1' and the rear connection member 4' from each other, it is only needed to apply a force to the operating end 33' of each of the engaging-disengaging members 3' and enable the circular arc abutting portion 341' of the abutting end 34' of each of the engaging-disengaging members 3' to abut against the abutting portion 61' of each of the protrusions 6' according to the lever principle so that the fore connection member 1' and the rear connection member 4' can abut against each other to be disengaged in a time-saving and labor-saving way.

As described above and as described in the first preferred embodiment, no matter when the fore connection member 1' and the rear connection member 4' are snap-fitted into or disengaged from each other, the aforesaid purpose can be achieved simply and successfully through the aforesaid structural design (i.e., the purpose of increasing the convenience in engagement and disengagement, saving time and labor and improving the product quality can be achieved through the aforesaid structural design). In other words, the various efficacies described in the first preferred embodiment can also be achieved through the structure described in the second preferred embodiment.

Referring to FIG. 10 again, in this embodiment, a distance from the operating end 33' of each of the engaging-disengaging members 3' to the pivoting end 35' is larger than a distance from the abutting end 34' to the pivoting end 35'. As described in the first preferred embodiment, this distance (length) design may be changed depending on actual needs; that is, the aforesaid distance (length) design may be changed depending on actual needs under the consideration of the lever principle (the moment).

As described in the first preferred embodiment, the fore connection member, the rear connection member and the connection member formed by them may be such structures as terminal blocks, connectors and tracks. For example, the fore connection member is a fore terminal structure, the rear connection member is a rear terminal structure, and the connection member is a terminal structure.

Referring to FIG. 10 and FIG. 14 again, a stop block 211' is disposed on the two side surfaces 21' of the fore connection member body 2' respectively; a stop surface 36' is formed between the abutting end 34' and the pivoting end 35' of each of the engaging-disengaging members 3'; and each of the engaging-disengaging members 3' pivots about the fore connection member body 2' and has the stop surface 36' thereof abut against the stop block 211'. In other words, when the fore connection member 1' and the rear connection member 4' are snap-fitted into or disengaged from each other, the pivoting extent of each of the engaging-disengaging members 3' can be limited by the stop block 211', as shown in FIG. 14 (i.e., each of the engaging-disengaging members 3' is prevented from pivoting to such an extent that the grab 32' and the abutting portion 61' cannot be accurately aligned with each other).

The invention claimed is:

1. A combination of a fore connection member and a rear connection member, comprising:

a fore connection member body, comprising two side surfaces;

two engaging-disengaging members, being pivoted to the two side surfaces respectively and each comprising a recess, a grab, an operating end, an abutting end and a pivoting end, wherein each of the engaging-disengaging members has the pivoting end thereof pivoted to a corresponding one of the side surfaces of the fore connection member body and pivots about the fore connection member body, the operating end and the abutting end are disposed at two sides of the pivoting end respectively, the grab is provided with a hook portion facing the abutting end, the abutting end is provided with a circular arc abutting portion comprising a circular arc abutting surface, and the circular arc abutting surface is smoothly connected to the recess;

a rear connection member body, comprising two side surfaces; and two protrusions, being disposed on the two side surfaces respectively and each comprising an abutting portion and a snap-fitting portion, wherein each of the protrusions has a recessed portion recessed longitudinally with respect to the abutting portion, and the recessed portion is smoothly connected to the abutting portion, wherein the rear connection member and the fore connection member are operatively longitudinally inserted into each other.

2. The combination of a fore connection member and a rear connection member of claim 1, wherein a distance from the operating end to the pivoting end is larger than a distance from the abutting end to the pivoting end.

3. The combination of a fore connection member and a rear connection member of claim 1, wherein the fore connection member is a fore terminal structure.

4. The combination of a fore connection member and a rear connection member of claim 1, wherein the rear connection member is a rear terminal structure.

5. A combination of a fore connection member and a rear connection member, comprising:

a fore connection member body, comprising two side surfaces;

two engaging-disengaging members, being pivoted to the two side surfaces respectively and each comprising a recess, a grab, an operating end, an abutting end and a pivoting end, wherein each of the engaging-disengaging members has the pivoting end thereof pivoted to a corresponding one of the side surfaces of the fore connection member body and pivots about the fore connection member body, the operating end and the abutting end are disposed at two sides of the pivoting end respectively, the grab is provided with a hook portion facing the abutting end, the abutting end is provided with a circular arc abutting portion comprising a circular arc abutting surface, and the circular arc abutting surface is smoothly connected to the recess;

a rear connection member body, comprising two side surfaces; and two protrusions, being disposed on the two side surfaces respectively and each comprising an abutting portion and a snap-fitting portion, wherein each of the protrusions has a recessed portion recessed longitudinally with respect to the abutting portion, and the recessed portion is smoothly connected to the abutting portion, wherein the rear connection member and the fore connection member are longitudinally inserted into each other, each of the protrusions of the rear connection member is contained in the recess of each of the engaging-disengaging members of the fore connection member, the abutting end of each of the engaging-disengaging members of the fore connection member correspondingly extends into the recessed portion of each of the protrusions of the rear connection member, and the hook portion of each of the engaging-disengaging members of the fore connection member is correspondingly snap-fitted in the snap-fitting portion of each of the protrusions of the rear connection member.

6. The combination of a fore connection member and a rear connection member of claim 5, wherein the rear connection member is a rear terminal structure.

* * * * *